United States Patent [19]

Mehltretter

[11] Patent Number: 4,887,773

[45] Date of Patent: Dec. 19, 1989

[54] ROTARY MILL WITH CHARGING SYSTEM

[75] Inventor: James C. Mehltretter, Cary, N.C.

[73] Assignee: Inco Alloys International, Inc., Huntington, W. Va.

[21] Appl. No.: 222,014

[22] Filed: Jul. 21, 1988

Related U.S. Application Data

[63] Continuation-in-part of Ser. No. 923,341, Oct. 27, 1986, abandoned.

[51] Int. Cl.[4] ..... B03C 17/04

[52] U.S. Cl. ..... 241/171; 220/85 F; 241/101.2; 241/176; 241/180; 241/199.6; 241/DIG. 14; 366/182

[58] Field of Search ..... 220/85 F, 86 R; 366/76, 366/182; 414/292; 241/100, 101.2, 171, 176, 180, 199.6, DIG. 14; 222/559, 544

[56] References Cited

U.S. PATENT DOCUMENTS 1,911,575 5/1933 Lee ..... 366/182
2,805,827 9/1957 Pierce ..... 242/171
3,152,624 10/1964 Ridley ..... 220/86 R X
4,679,736 7/1987 Orlando ..... 241/25

FOREIGN PATENT DOCUMENTS 325347 9/1920 Fed. Rep. of Germany ..... 222/559

*Primary Examiner*—Joseph M. Gorski
*Attorney, Agent, or Firm*—Francis J. Mulligan, Jr.; Edward A. Steen

[57] ABSTRACT

A rotary-type mill is provided with a system for charging powder to a mill under seal from atmospheric air, the system being comprised of a sealable loading conduit and a valve assembly. The valve assembly, which controls the opening to the mill, is disposed in part in the sealable loading conduit, and is operable without breaking the seal to the atmosphere. In addition to permitting charging and operations of the mill in a protective environment, the system is designed for gravity-dependent essentially unencumbered vertical entry of feed to the mill and for minimization of the problem of wear of machine parts during operation of the mill.

3 Claims, 3 Drawing Sheets

ROTARY MILL WITH CHARGING SYSTEM

This application is a continuation in part of application Ser. No. 923341, filed 10/27/86, and now abandoned.

FIELD OF INVENTION

This invention relates to an improved system for charging materials to a container under a protective atmosphere. More particularly it relates to a valve system for charging particulate material to a batch-type mill under seal from the atmosphere.

BACKGROUND OF INVENTION

In milling certain types of materials it is often necessary or desirable to have a positive control of the atmosphere within the mill at all times. For example, readily oxidizable materials such as aluminum, titanium, magnesium, lithium and fine powders of many compositions are combustible or even explosive under certain conditions or they may be contaminated by the presence of air. In milling such materials the control of the atmosphere must extend to charging and discharging of the mill without opening the mill to air.

In designing apparatus to be used for metals and other powders special consideration must be given to valve design when the powders will come in contact with a valve because the powders will find their way into valve parts and render the valve inoperable.

The problems encountered in milling powders are particularly troublesome in the mechanical alloying of readily oxidizable metals such as aluminum, titanium, magnesium, lithium, and rare earths such as cerium. Mechanical alloying has been described in detail in the literature and in patents. U.S. Pat. Nos. 3,740,210, 3,816,080 and 3,837,930, for example, involve the mechanical alloying of aluminum alloys and other composite materials containing aluminum. In the practice of mechanical alloying the components of the product are charged in powder form into a high energy milling device such as a ball mill where, in an environment free of or reduced in amount of free or combined oxygen, the powders that are dry or substantially dry are ground down to a very fine size initially, prior to particle agglomeration in the latter stages of the process. This initial grinding increases the total surface area of the metallic powders significantly. Since any freshly exposed surface is not oxidized, it is very hungry for oxygen to the extent that the powders in this condition will burn and/or might explode spontaneously if exposed to air. Thus, any port in the mill, for example, for charge or discharge of powders, is a source of potential danger from the standpoint of the quality of the product produced and the possibility of a fire and/or an explosion.

In batch-type grining mills it has been conventional to provide charging devices which are normal to the mill. That is, when the mill shell is positioned for loading, the charging device is in a vertical position with the charge port at the top of the shell. In U.S. Pat. No. 4,679,736, loading means in an improved design is disclosed. In the improved design the loading means is in a vertical position when the mill shell is rotated so that the loading means is on the side of the mill with unencumbered, gravity-dependent entry for the feed material into the shell. Also disclosed is apparatus for utilizing the disclosed charging design in mills in which a protective atmosphere is required. The present invention is particularly effective with the positioning design of the loading means of the aforementioned disclosure.

The present invention involves a valve system for charging rotary mills in a manner which will protect the charge material and the environment in the mill during loading of the mill, while at the same time it is designed to minimize the problem of wear of the valve parts during operation of the mill.

The charge system of the present invention can be incorporated into existing batch-type rotary mills, permitting them to be charged and operated under protective conditions.

STATEMENT OF THE INVENTION

In the present invention a batch-type rotary mill for processing powder and capable of operating under controlled conditions is provided with an improved charging system. The mill comprises a rotatably mounted, closed-ended shell, having a means to rotate the shell and at least one charge passage means, e.g. an orifice, located in the peripheral wall of the shell for passing material into the shell. The improved system for charging material to the mill comprises a gravity-dependent loading means secured to the shell over each charge passage means and sealable from atmospheric air with respect to the charge passage means and a sealable charging means mountable on the loading means, said loading means comprising an essentially straight, tubular loading conduit extending straight away from the shell having sealing means outboard of the shell, and a valve assembly at least part of which is disposed in the loading conduit and sealable to the atmosphere, the sealable loading conduit comprising a port of entry and an exit port for passage of the charge material into the shell, said exit port being aligned with the charge passage means in the shell for passage of the charge material from the loading conduit into the shell, and the valve assembly comprising a valve plug sealably mountable in the charge passage means in the shell, valve opening means to remove the valve plug from the hollow shell so as to permit charging of the hollow shell and valve closing means to seal the valve plug in the shell, the valve plug having an open position interior of the shell and a closed position substantially coextensive with the peripheral wall of the shell and the valve opening and closing means being operable while the loading means is sealed from the atmosphere, whereby said mill can be loaded under seal from the atmosphere. The closed-ended shell has a horizontal axis and a vertical axial plane and the essentially straight tubular loading conduit is so positioned that when upon rotation of said shell, the longitudinal axis of said essentially straight tubular powder conduit is vertical, the powder conduit will lie to one side of the vertical axial plane of said shell. The sealable charging means, e.g. a receptacle sealable to the atmosphere mountable on the loading means, is used to feed material to the loading means.

The valve system is designed so that in the open position the valve plug extends into the shell and in the closed position the valve plug seats sealably in the orifice with its inner face substantially continuous with the inner circumference of the shell, so that there are essentially no valve projections into the mill, which projections could be worn away by action of the mill. When the valve plug is closed during operation of the mill, the interior of the shell is essentially smooth and continuous. The valve plug can be constructed of a material that is at least as wear resistant as the interior of the shell so that no greater wear would be attributable to the valve plug.

To charge the mill, the shell (which is maintained sealed from the air) is rotated until the loading conduit is located in a generally vertical position at the side of the mill and then held stationary in position. The design of the loading conduit makes it possible for the charge material to flow vertically downward into the mill when the loading conduit is at the side of the mill. After removing the closure means, e.g. a blind flange, from the loading means, a charge receptacle containing the charge material is attached to the loading means at the entry port of the loading conduit. The charge receptacle is sealed to the atmosphere, e.g. by means of a valve device which can be opened to permit flow of charge material to the mill. While the loading conduit is sealed from the charge receptacle and the shell, it can, if desired, be evacuated or purged, e.g. with a gas inert to the charge material, using apparatus suitably placed in the system. Then the valve plug is moved to the open position, e.g. extended into the mill shell so as to minimize retention of the charge material on the valve parts, and the valve of the charging receptacle is opened to permit the charge material to flow into and through the generally vertically disposed loading conduit into the shell.

After charging the material into the shell, the valve plug is closed, the closure means sealably isolating the loading tube from the mill. Then the charging receptacle with its sealing means is removed from the mill. Thereafter the loading conduit can be resealed with the blind flange and the mill rotated.

There may be more than one loading means along the length of the mill, as will be appropriate, for example, to the length of the shell and the quantity of material to be charged.

The present invention applies to batch-type grinding mills, e.g. ball mills, for processing particulate material. The grinding media may be, for example, balls, rods, pebbles or other appropriate media. The material processed in the mills may comprise elements, compounds, mixtures, alloys, ceramics and combinations thereof. Examples of elements which may be present as major or minor constituents of the product are nickel, copper, zinc, titanium, zirconium, niobium, molybdenum, vanadium, tin, aluminum, chromium, magnesium, lithium, iron, silicon, yttrium and rare earths, e.g. cerium and lanthanum; examples of compounds are oxides, nitrides and/or carbides of aluminum, magnesium, silicon, yttrium, cerium and lanthanum; examples of alloys are master alloys of aluminum-lithium and aluminum-magnesium. The present invention is particularly useful when the material to be processed must be charged to and/or processed in a mill under a controlled atmosphere.

The invention is particularly useful for the processing in a ball mill metal powders which are readily oxidized and are prepared as dispersion strengthened materials or alloys by powder metallurgy routes. Of necessity the milling of such materials must be carried out in a controlled atmosphere, e.g., in a hermetically sealed or purgative atmosphere, or in an environment of controlled gas flow such as an inert gas, or in an atmosphere of inert gas which contains specific amounts of process controlled agents, e.g. hydrocarbons, alcohols, acids, etc. it will be understood, however, that the present invention is especially useful generally, for processing in a mill any materials where a controlled atmosphere is required or beneficial. For example, the present invention can be used advantageously for preparing by a powder metallurgy route dispersion strengthened alloys having, e.g., nickel, titanium, chromium, magnesium, copper, iron or aluminum as a major constituent.

BRIEF DESCRIPTION OF DRAWING

A further understanding of the invention and its advantages will become apparent from the following description taken in conjunction with the accompanying drawing in which.

DESCRIPTION OF A PREFERRED EMBODIMENT

Figure 1:
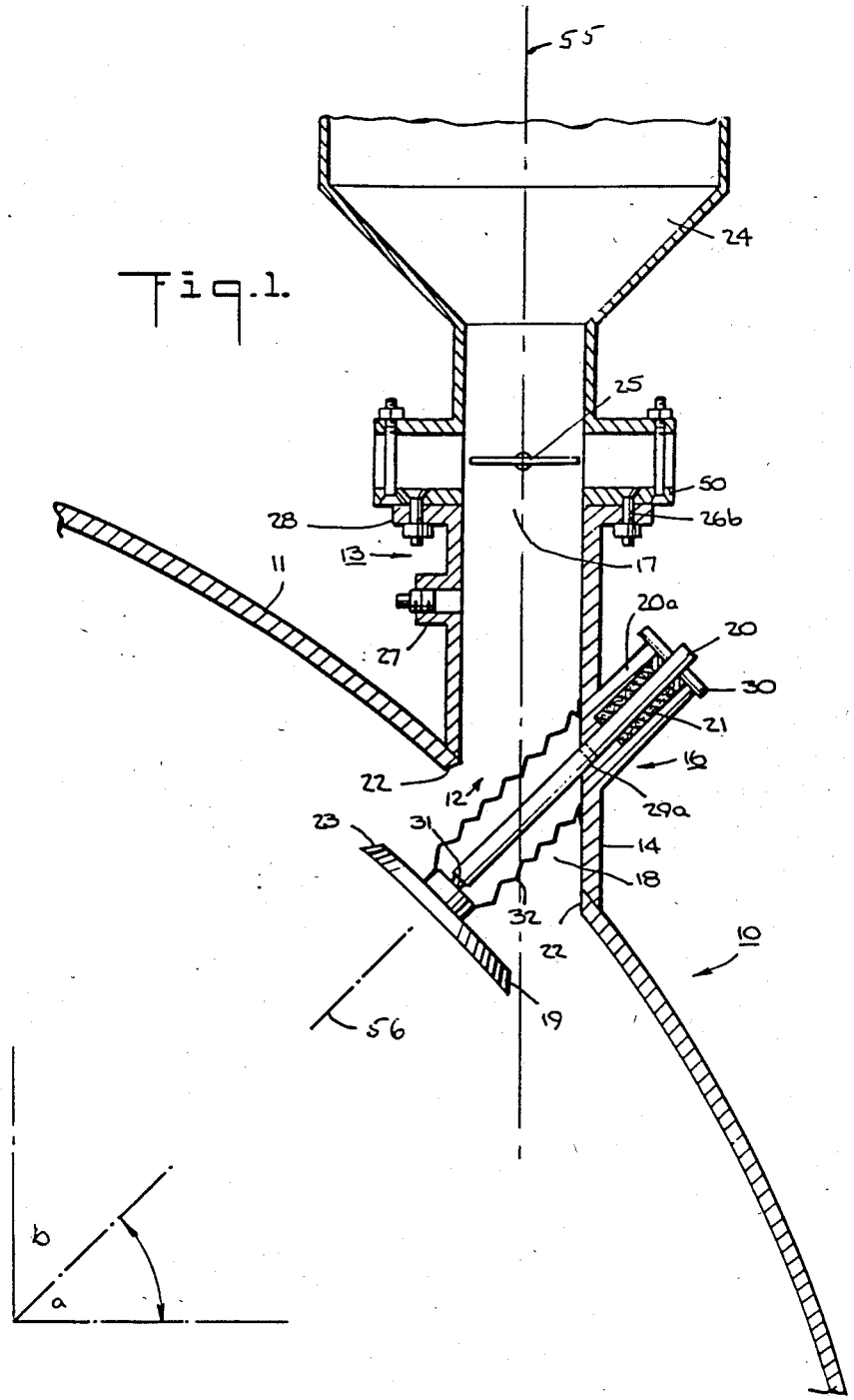
FIG. 1 is a diagrammatic view in cross-section of the charging portion of a ball mill provided with the improved valve assembly system of the present invention and showing the valve in the charging mode with the charging receptacle in place on the loading means and both the loading means and charging receptacle sealed to the atmosphere..
Figure 2:
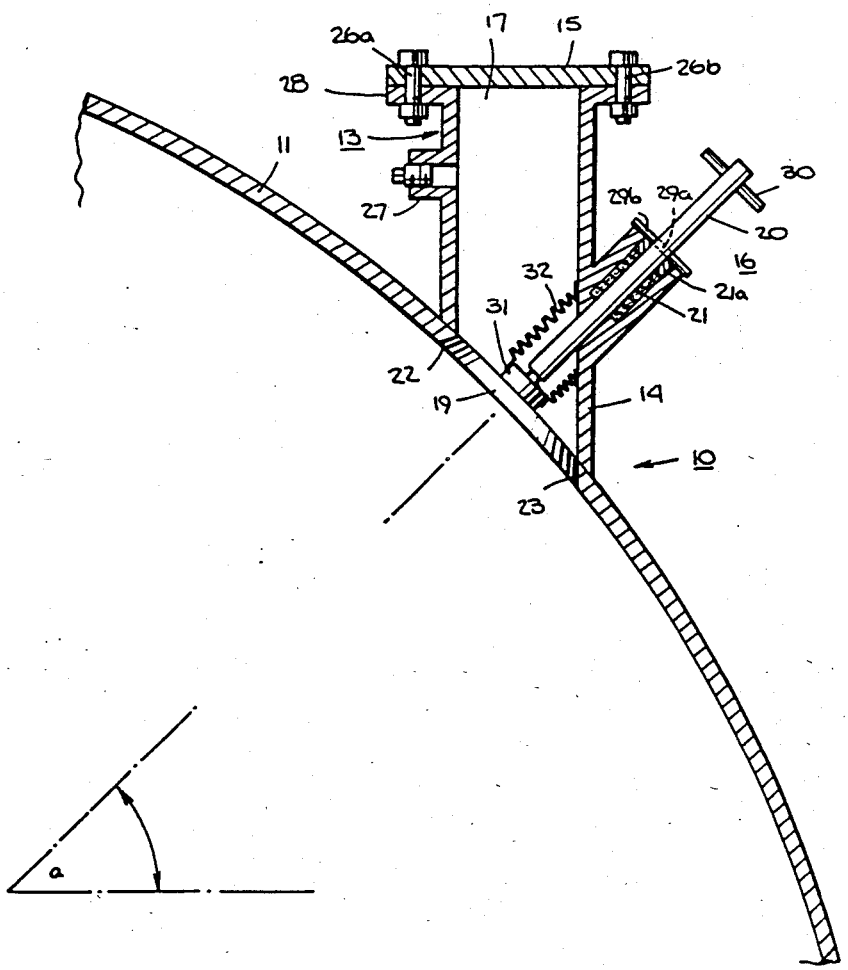
FIG. 2 is essentially the same view of the charging portion of the mill as FIG. 1, except that the valve plug is shown in the closed position with the loading means sealed from the atmosphere.

Referring to the drawings, FIGS. 1 and 2 show a diagrammatic view in cross-section of the charging portion 10 of a ball mill comprising a portion of a rotatably mounted, hollow, cylindrical, metal shell 11, having an orifice 12 for the passage of the charge material into the mill, and sealably secured on the shell a loading means 13 for charging powder into the mill while sealed to the atmosphere. The loading means 13 comprises an essentially straight, tubular loading conduit 14 extending straight away from the shell 11 having removable sealing means 15, e.g. a blind flange, and a valve assembly 16. Reference numeral 55 reprsents the longitudinal axis of the loading conduit 14.. The loading conduit 14 has an entry port 17 and an exit port 18, and it may be fitted with a conduit valve (not shown). The exit port 18 from the loading conduit is aligned with orifice 12, providing a smooth, unencumbered, direct passage for the charge material into the mill. The removable sealing means 15 is used to seal the loading conduit after shell 11 has been charged. Charging receptacle 24, equipped with butterfly valve 25 (alternatively, a slide gate or any other appropriate valve) is connected at the entry port 17 to the loading means 13 by means of bolts 26*a* and 26*b* through flanges 28 and 50. The valve assembly 16 of the loading means, having an axis of symmetry 56, in turn comprises a valve plug 19 and a sealed valve activating means for opening and closing the valve. The valve plug 19 is designed to fit into sealable relationship with shell 11 so as to form a hermetical seal on the shell with respect to the loading means 13 in the orifice 12 when the valve is in the closed position. The valve activating means may be comprised of valve stem 20 rigidly or flexibly connected at connection means 31 to the valve plug 19 to allow for plug alignment. (Alternative alignment means may be provided.) The valve stem 20 permits opening and closing of the valve plug 19 in shell 11 without exposing material in the loading conduit 14 to the air. Loading conduit 14 is adapted with a sealed entry means, viz. valve packing 21, packing nut 21a, and valve stem guide 20a for the valve stem 20.

Slidable bushings, e.g. Teflon®, may be used to assist in positioning the valve plug. Valve stem 20 extends outside the seal, providing a means for controlling the opening and closing of the valve from a position outside the sealed portion of the loading means 13 without exposing the interior of the shell to air. Flexible bellows 32 also seal powder out of the valve stem area. Other powder excluding means may be used in addition to or instead of the flexible bellows. To seal the shell, orifice 12, which may be any shape but is preferably round or elliptical, is provided with a valve plug seat having a beveled rim 22, and valve plug 19 is machined at rim 23 to mate securely with a valve plug seat beveled rim 22 and seal the shell when the valve is in the closed position. Alternatively, e.g., rim 23 or seal 22 may be the segment of a sphere or other curve to improve valve seating and alignment. Additionally an elastomerictype material may be used to provide a further seal between the valve plug and the orifice. In the preferred embodiment the valve stem angle a is about 45°. If sealing faces 22 and 23 are at an angle of about 45° to the valve stem 20, then all portions of 22 are either vertical or beyond the vertical, eliminating surfaces on which powder may accumulate. By virtue of simple geometry vis-a-vis angle a, angle b reprsents the angle between the longitudinal axis 55 and the axis of symmetry 56. During powder charging periods, the mill is rotated so that the longitudinal axis 55 is substantially vertical.

The valve plug 19 is constructed, for example, of an abrasion resistant material so that it will not be worn away during the grinding cycle of the mill. The valve stem 20 is provided with means **29*a* and 29*b* (an orifice and pin, respectively) to hold it in the closed position, and with a means 30, (a stem stop) to limit the travel of the stem in open position. Alternatively, for example, stem 20 could be threaded for valve opening and closing. In addition, by gauging the position fo the stem 20 on the ouside, it is possible to determine if the valve is open for charging or seated for running. Means for purging or evacuating the loading conduit is provided by purge port 27**, which is fitted so that a vacuum line and/or purge gas line can be connected to the loading conduit.

FIG. 1 shows schematically the valve plug in the open position with a charging receptacle sealed to the entry port, and FIG. 2 shows the closed position of the valve plug with the blind flange in place. It will be understood that the orifice 12 will be sealed with the valve plug during operation of the mill. In the closed position there are no projecting parts of the valve into the interior of the mill shell 11. In the open position, in the preferred configuration as explained above, the valve seat 22 is vertically aligned with the loading conduit 14 at the lower end of the orifice and horizontal at the upper end. This arrangement provides for flow-through of charge material without encumbrances to the passage of powder into the shell.

The mill shell may be, for example, cylindrical, spherical, double or single conical, multi-flat sided, etc. The exact shape of the mill shell is not critical to the invention. Mills may also be double walled (or jacketed) for mill shell cooling or heating. Water or other cooling media may be passed through this space (or jacket). Many varieties of mills and mill adaptations may be used, but it will be appreciated that these adornments are not a factor in this invention. The loading means may be sealably mounted on the outer side of the shell with, e.g. a flange. To obviate the need for alignment of the loading port on the entire shell, the complete loading means assembly including a section of the shell with the orifice can be mounted separately into the shell. This arrangement would also be convenient for repair and replacement of the loading means without otherwise disturbing the mill.

Figure 3:
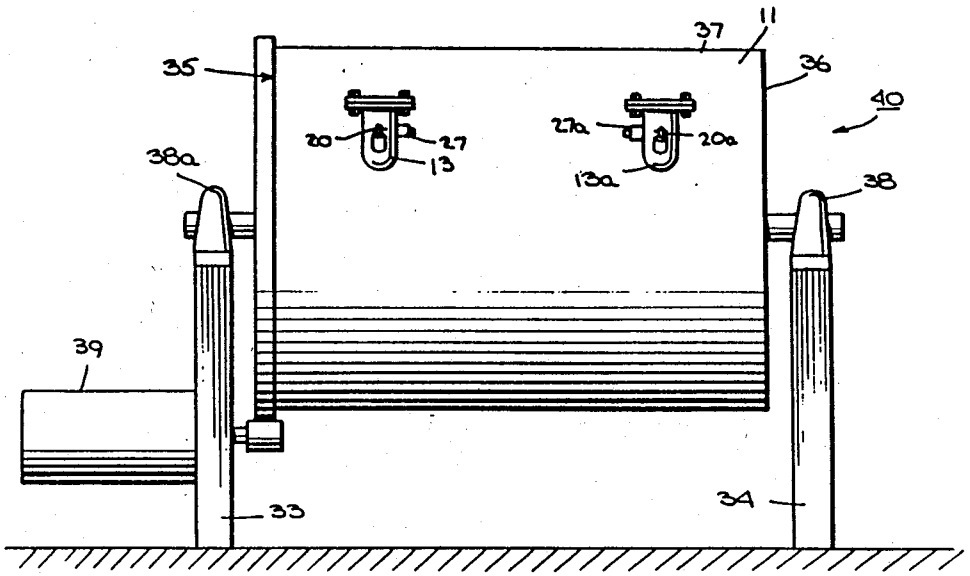
FIG. 3 is a schematic diagram of a ball mill in accordance with this invention showing the multiple loading means in position for charging the mill.

FIG. 3 shows a preferred embodiment of the present invention in which a pair of loading means 13 and **13*a* are located on the periphery of rotatably mounted shell 11 of a ball mill 40. The ball mill comprises a pair of support members 33 and 34, a cylindrical shell 11, mounted for rotation about an approximately horizontal axis on trunnion bearings 38 and 38*a*. The shell comprises closed ends 35 and 36, a peripheral wall 37 and a pair of charging orifices (concealed in the drawing by the loading means 13 and 13*a*, respectively). The charging orifices are sealable from the atmosphere, respectively, by the pair of loading means 13 and 13*a* secured on the shell 11 to cover the respective charging orifices. The grinding medium, i.e. the balls, are not shown. At end 35 of the shell is the rotating means 39 for rotating the mill such as a motor and associated gearing or belting. Positioning means, such as a brake, are associated with the rotating means 39 to stop the mill and hold it stationary so that the powder may be charged into the mill through the vertically oriented loading conduit 14**.

When the longitudinal axis (not shown in FIG. 3) of each of loading means 13 and **13*a* are in the essentially vertical position so as to permit charging of the mill under the force of gravity, the loading means 13 and 13*a* are located to one side of the vertical axial plane of rotary mill shell 11, with a portion of valve stems 20 and 20*a* visible. Shell 11** is sealed from the air and is provided with a means (not shown) for feeding into or establishing in the shell a desired environment, e.g. nitrogen, argon or other elemental or mixed gas with or without process control additives, e.g. controlled amounts of hydrocarbons or oxygen or carbon. Means to discharge material from the mill is not shown. A suitable means of discharging the mill is disclosed, for example, in U.S. Pat. No. 4,603,814.

In operation of the improved valve assembly of the present invention, the charge materials, e.g. metal powders, are charged through the loading means under sealed conditions. While maintaining the loading means under sealed conditions, charging receptacle 24 with valve 25 closed is attached to the loading means, the valve stem 20 is operated to move valve plug 19 into the open position, i.e. extended into the rotary shell, thereby opening the orifice in shell. Valve 25 is then opened, thereby releasing charge material from the receptacle. the powder charge will then flow through the loading conduit into the interior of rotary mill shell. After the powder charge has drained from the charge receptacle through the loading means into the shell, the valve stem 20 is used to retract and secure the valve plug 19 to the shell face. The charge receptacle can then be removed. The loading conduit is maintained sealed from the atmosphere after the charge receptacle is removed.

In the embodiment shown in the drawing the mill shell is rotated about an essentially horizontal central axis. In another embodiment of the invention the charging system is adapted for placement on a mill with the drum operated to rotate about a non-horizontal axis.

Although the present invention has been described in conjunction with preferred embodiments, it is to be understood that modifications and variations may be resorted to without departing from the spirit and scope of the invention, as those skilled in the art will readily understand. Such modifications and variations are considered to be within the purview and scope of the invention and appended claims.

The embodiment of the invention in which an exclusive propety or privilege is claimed are defined as follows:

1. In combination with a controlled environment rotary mill having a shell and an aperture therethrough, an apparatus for introducing powder substantially vertically downward into the mill when the mill is stationary and for insulating the powder from the atmosphere, the apparatus comprising a loading conduit communicating with the aperture and having a side wall extending straight away from the shell, the loading conduit having a longitudinal axis the loading conduit adapted to be detachably connected to a powder source, a movable valve extending through the side wall of the loading conduit and in a sealable relationship with the aperture, the valve having an axis of symmetry, the longitudinal axis of the loading conduit and the axis of symmetry of the valve intersecting at about 45°, means for sealing the interior of the loading conduit from the atmosphere, means for rotating the mill, means for extending and retracting the valve, and positioning means for maintaining the mill in a stationary position so that the longitudinal axis of the loading conduit is substantially vertical during powder introduction.

2. The combination according to claim 1 wherein the valve includes a stem and a plug, the plug having a rim adapted to seal the aperture and at least a portion of the rim being parallel with the longitudinal axis of the loading conduit.

3. The combination according to claim 2 wherein the plug is flexibly affixed to the valve stem.

* * * * *